US006513771B1

(12) United States Patent
Tucker

(10) Patent No.: US 6,513,771 B1
(45) Date of Patent: Feb. 4, 2003

(54) HANDY PAINT HOLDER

(76) Inventor: Kenneth L. Tucker, P.O. Box 152, Hailey, ID (US) 83333

( * ) Notice: Subject to any disclaimer, the term of this patent is extended or adjusted under 35 U.S.C. 154(b) by 0 days.

(21) Appl. No.: 09/565,209

(22) Filed: May 4, 2000

(51) Int. Cl.[7] ..... E06C 7/14; A47L 13/56
(52) U.S. Cl. ..... 248/211; 15/257.06
(58) Field of Search ..... 248/211, 317, 248/318, 339, 340, 341, 210; 220/751, 757, 756; 15/257.06, 257.05

(56) References Cited

U.S. PATENT DOCUMENTS

| | | | | | |
|---|---|---|---|---|---|
| 1,551,242 | A | | 8/1925 | Dick | |
| 1,551,243 | A | | 8/1925 | Dick | |
| 2,686,032 | A | | 8/1954 | Thorson | 248/211 |
| 2,723,410 | A | * | 11/1955 | Sprung et al. | 15/257.06 |
| 3,252,613 | A | * | 5/1966 | McGrath | 220/23.87 |
| 3,395,828 | A | * | 8/1968 | Schnabel | 220/697 |
| 3,595,431 | A | * | 7/1971 | Bird | 220/697 |
| 3,729,092 | A | * | 4/1973 | Marcell | 206/303 |
| 3,819,140 | A | | 6/1974 | Stewart | 248/110 |
| 3,980,264 | A | | 9/1976 | Tomasik | 248/210 |
| D245,450 | S | * | 8/1977 | Donlon | D32/53.1 |
| D250,742 | S | * | 1/1979 | Wendler | D8/372 |
| 4,860,891 | A | * | 8/1989 | Biggio | 206/362 |
| 4,927,046 | A | * | 5/1990 | Armstrong | 220/697 |
| D316,171 | S | * | 4/1991 | Chatham et al. | D3/304 |
| 5,035,386 | A | | 7/1991 | Tucker | 248/110 |
| 5,035,387 | A | | 7/1991 | Gizzi | 248/110 |
| 5,390,888 | A | | 2/1995 | Rogers | 248/318 |
| 5,402,910 | A | | 4/1995 | Pilney | 220/751 |
| 5,493,751 | A | | 2/1996 | Misiukowiec et al. | 15/257.06 |
| 5,546,628 | A | * | 8/1996 | Silvera | 15/257.06 |
| 5,564,566 | A | * | 10/1996 | Lamb | 206/373 |
| D375,889 | S | * | 11/1996 | Miller et al. | D8/367 |
| D401,704 | S | * | 11/1998 | Clark | D32/53.1 |
| 5,836,043 | A | | 11/1998 | Rovas | 15/257.06 |
| 5,842,253 | A | * | 12/1998 | Ahl et al. | 15/257.06 |
| 5,971,201 | A | * | 10/1999 | Daw | 220/697 |

FOREIGN PATENT DOCUMENTS

| | | | |
|---|---|---|---|
| GB | 2251843 | * | 7/1992 |

* cited by examiner

*Primary Examiner*—Anita King
(74) *Attorney, Agent, or Firm*—Pedersen & Co., PLLC; Ken J. Pedersen; Barbara S. Pedersen

(57) ABSTRACT

A paint holder is disclosed that has a rectangular container with a top opening for receiving liquids such as paint, laquer, denatured alcohol, and has a handle, a hanging hook, and a splash guard. Inside the container is an elongated ledge to rest a paint roller sleeve or paint brush bristles, while the roller or brush handle rests on the uppermost edge of the holder opposing the elongated ledge. The uppermost edge is also a straight edge that may be used to remove excess paint from the roller or brush. A user may hold the paint holder by the handle or may hang the device from a ladder or scaffolding rung so the user may always maintain one hand upon the support device while applying the liquid.

13 Claims, 6 Drawing Sheets

HANDY PAINT HOLDER

BACKGROUND OF THE INVENTION

1. Field of the Invention

The invention relates to painting equipment. Specifically, the device is a vessel for holding various liquid products and application instruments including brushes, rollers and sponges.

2. Related Art

The common cylindrical paint can efficiently stores and transports paint and provides a means to transfer the liquid upon demand. A painter choosing not to utilize a second paint storage medium for application requires a resting place for the application instrument. The resting typically used is the top of the open paint can. This choice is a messy proposition that Dick (U.S. Pat. No. 1,551,242), Tucker (U.S. Pat. No. 5,035,386) and Gizzi (U.S. Pat. No. 5,035, 387) overcome.

In addition, painters climbing ladders often hold a paint can in one hand and an application instrument in the other to paint tall places. This situation presents a safety hazzard because the painter must balance himself and the two objects while painting at elevated levels, and the painter must partially, or wholly, relinquish his grip on the ladder to wet the application instrument or apply paint.

Many devices address this safety issue by providing mechanisms to suspend a cylindrical paint can from a ladder including: Dick (U.S. Pat. No. 1,551,243), Thorson (U.S. Pat. No. 2,686,032), Stewart (U.S. Pat. No. 3,819,140), Tomasik (U.S. Pat. No. 3,980,264), Tucker (U.S. Pat. No. 5,035,386) and Gizzi (U.S. Pat. No. 5,035,387). Dick '243, Thorson '032, Stewart '140 and Tomasik '264 even include means to support an application instrument.

As roller brushes and other application instruments became common methods to apply paint, inventors went a step further to develop rectangular containers and paint trays that would accept paint from a can or other vessel and permit painters to patter, or roll, away excess material to evenly apply paint. Noteworthy examples of these developments are: Pilney (U.S. Pat. No. 5,402,910), Misiukowiec et al. (U.S. Pat. No. 5,493,751) and Rovas (U.S. Pat. No. 5,836, 043). The roller may rest on the bottom of the container or an internally placed ledge in these devices.

Rogers (U.S. Pat. No. 5,390,888) is a noteworthy example of a device that combines a device capable of suspending a liquid holding container and providing a hanging hook for the application instrument. Hanging an application instrument increases the surface-to-air ratio and paint drying rate, making the nap or bristles stiff or separated from encrusted paint. This condition leaves the application instrument prone to streaking or similar application defects that are often visible in door jambs, window sills and other trim pieces. However, if the roller rests in the paint it tends to absorb a paint excess that requires removal before application. On the other extreme, resting a roller sleeve on its lateral axis minimally damages the applicator nap.

The invented HANDY PAINT HOLDER combines a protrusion support mechanism and a rectangular paint container with a support rest for a paint application instrument that reduces safety concerns, minimizes excess paint absorbance and minimizes paint drying time upon the application instrument.

BRIEF SUMMARY OF THE INVENTION

The HANDY PAINT HOLDER is a container with a top opening for receiving paint, laquer, denatured alcohol, etc..

Within the container is an elongated ledge approximately 1–3 inches below the plane of the upper edge of the container and abutting or attached to one vertical side to rest a paint roller sleeve or paint brush bristles. On the uppermost portion of the side opposing the elongated ledge side is a straight edge to support the application instrument handle. The internal planar surface of said side above the paint level may be used to remove excess paint from a roller assembly. The straight edge also provides for removal of excess paint from paint brush bristles. At a medial position along the two uppermost edges of the lateral sides and the uppermost edge of the ledge side are supporting arms that support a handle and a swivel ring for a hook that attaches to the edge or rung of a ladder.

BRIEF DESCRIPTION OF THE DRAWINGS

The figures depict one, but not all, embodiments of the subject HANDY PAINT HOLDER device.

DETAILED DESCRIPTION OF THE INVENTION

Figure 1:
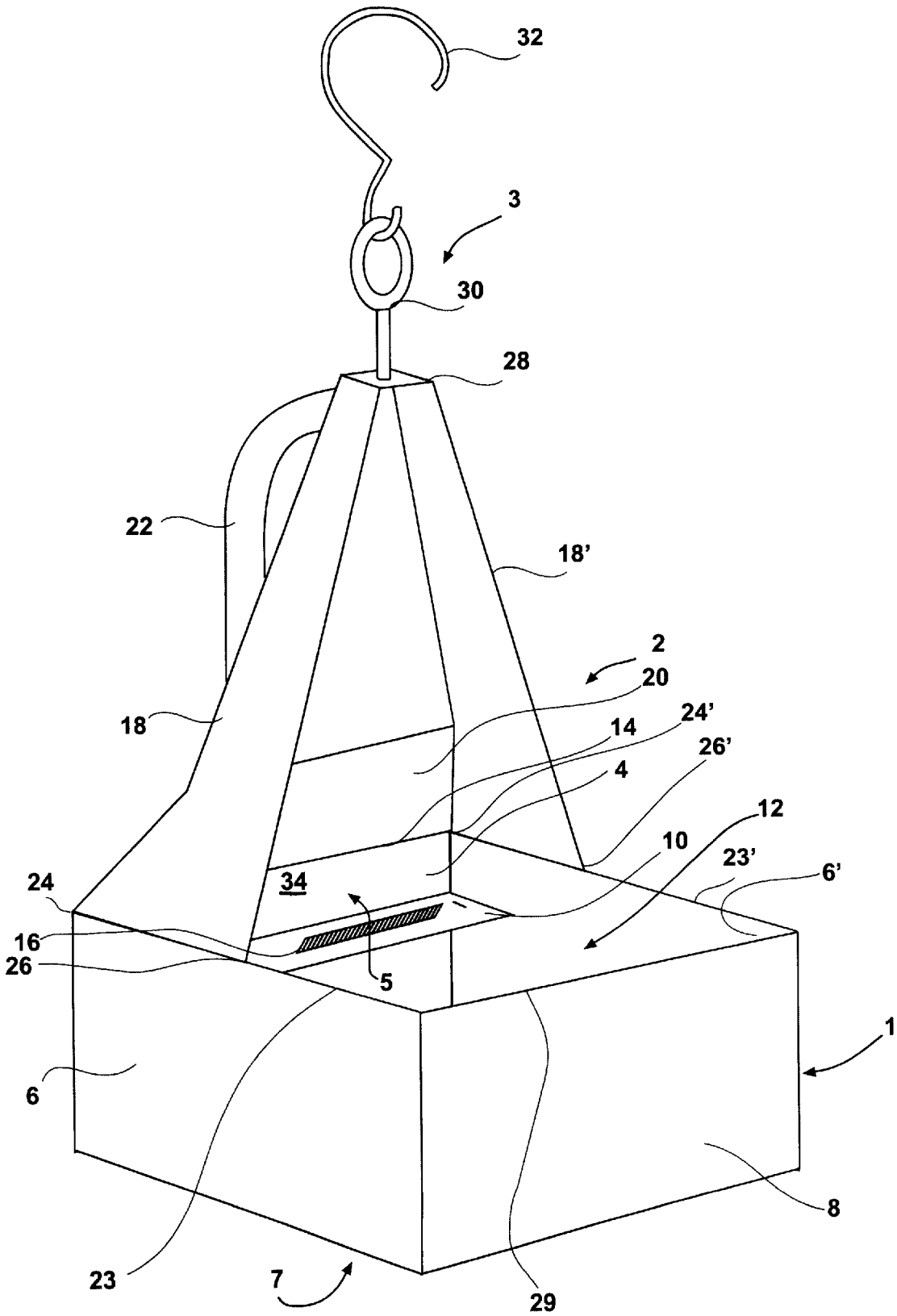
FIG. 1 is a perspective view of one device embodiment.
Figure 2:
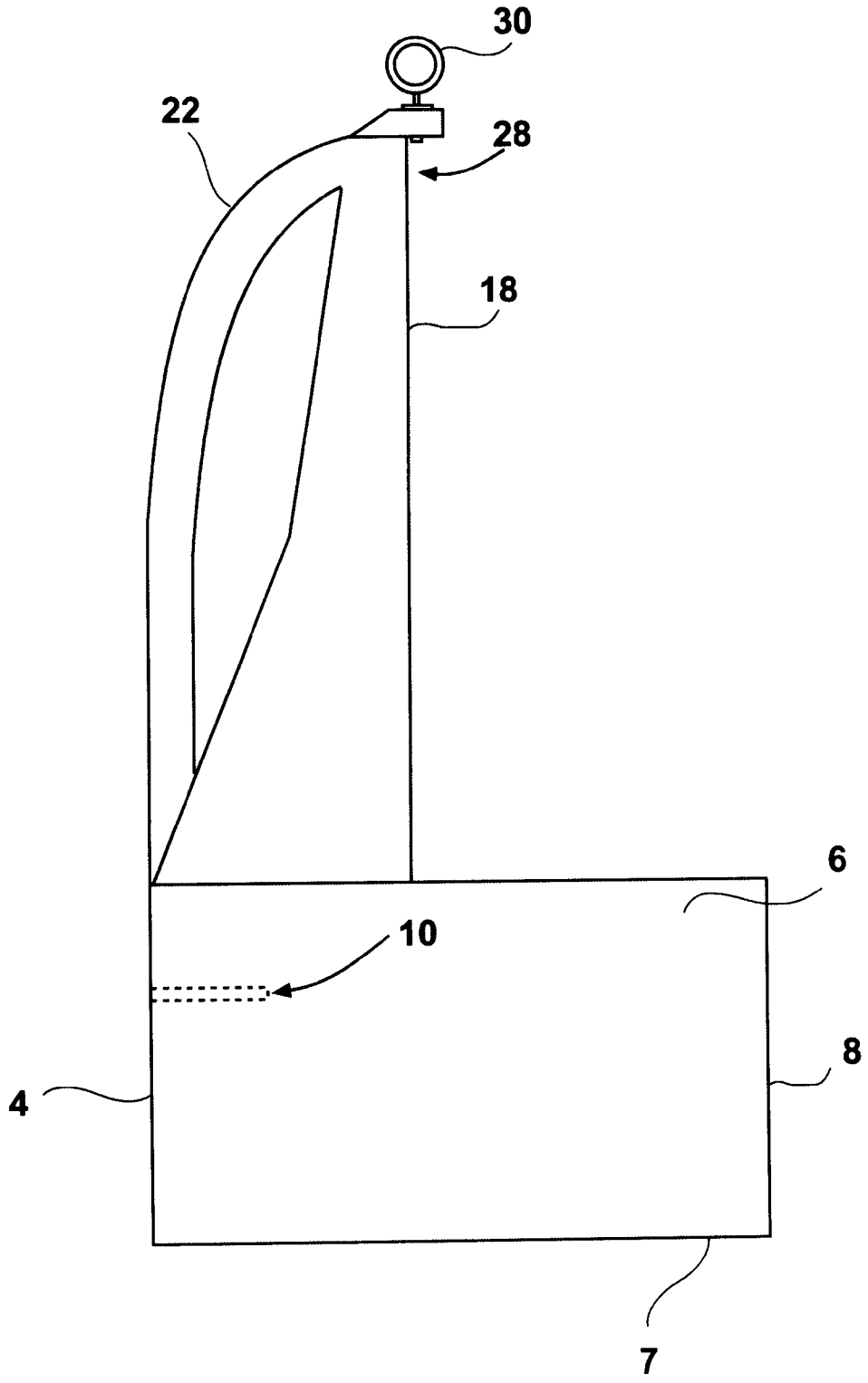
FIG. 2 is a side view of the embodiment presented in FIG. 1.
Figure 3:
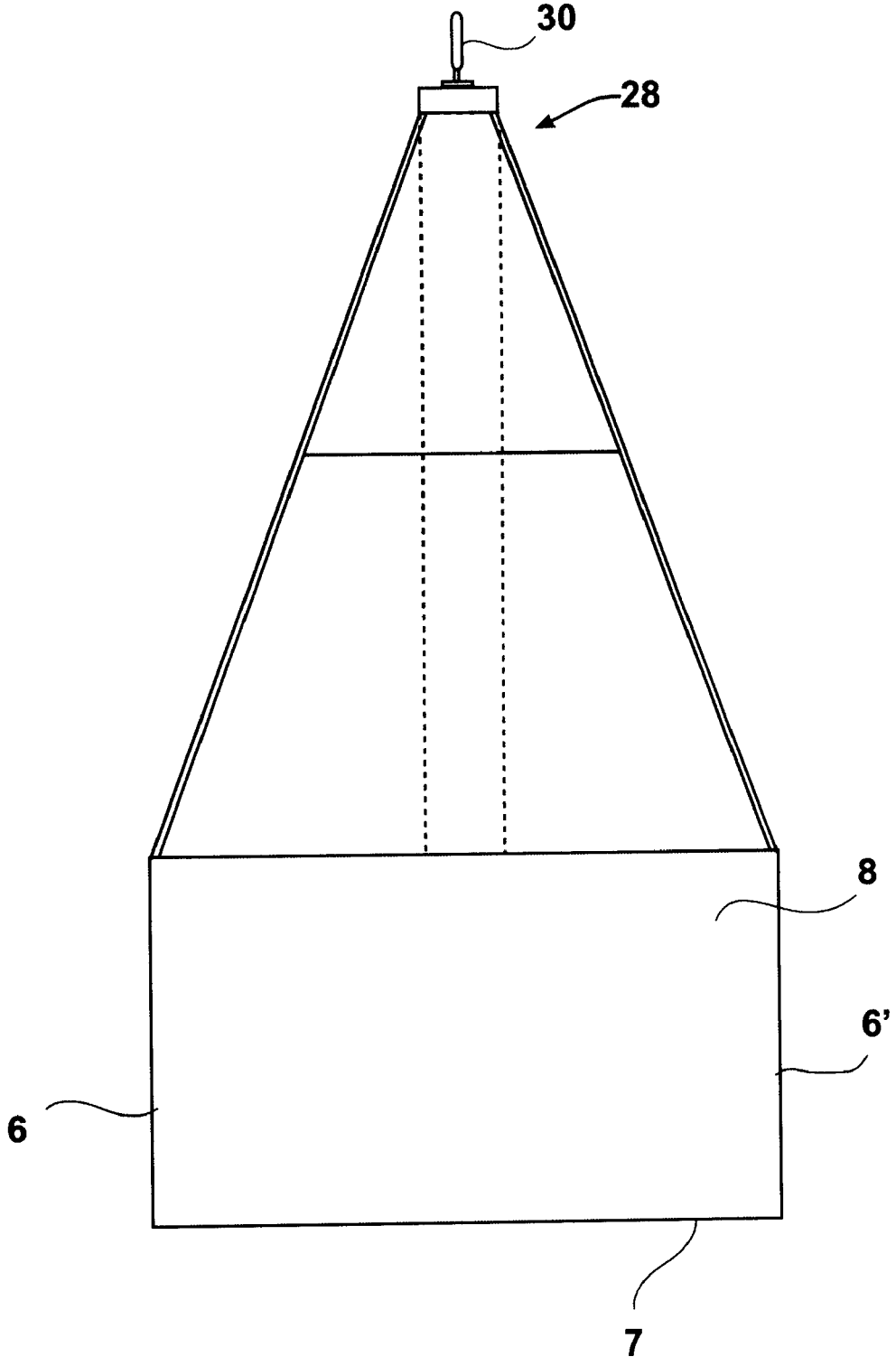
FIG. 3 is a front view of the embodiment depicted in FIG. 1.
Figure 4:
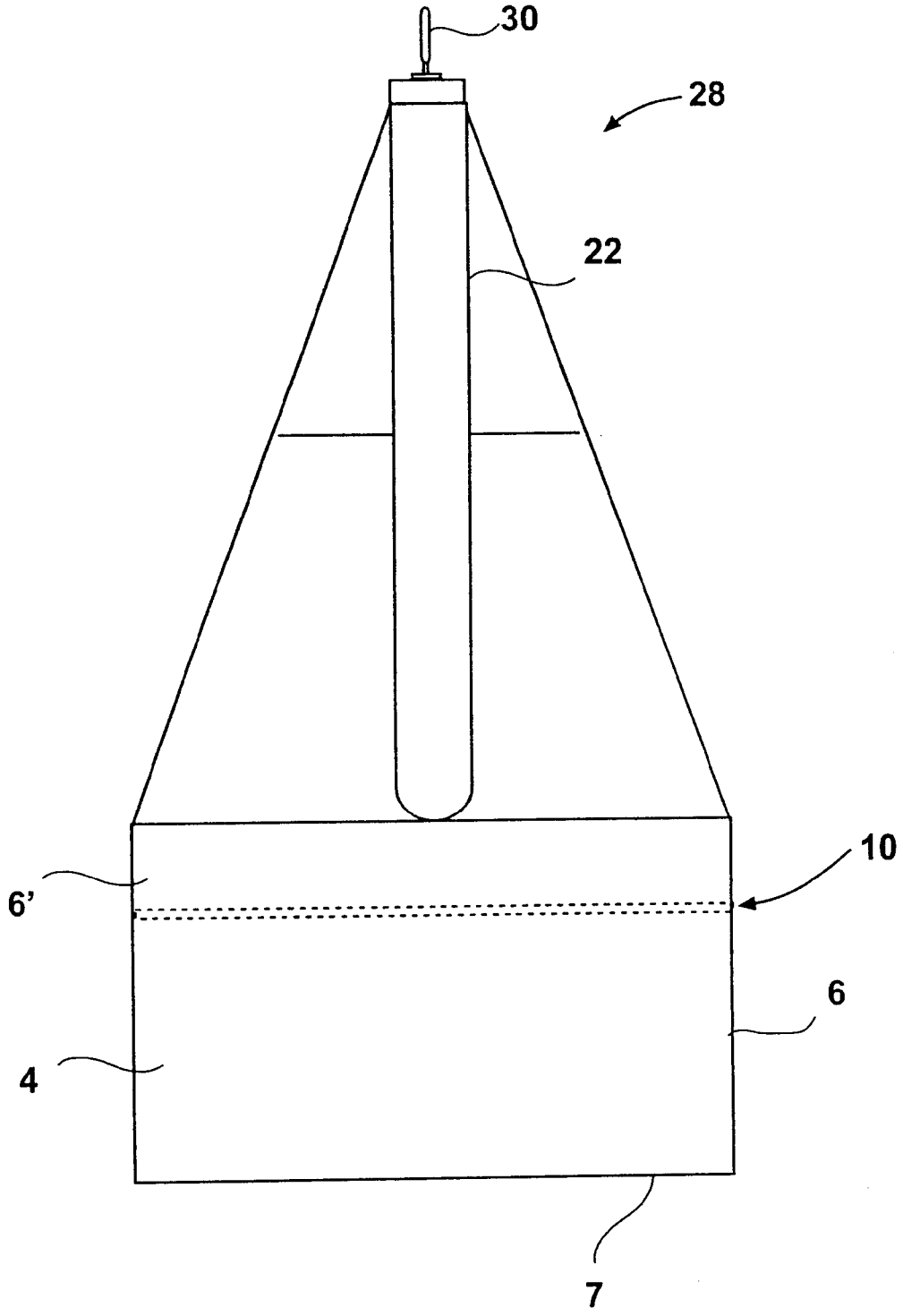
FIG. 4 is a rear view of the FIG. 1 embodiment.
Figure 5:
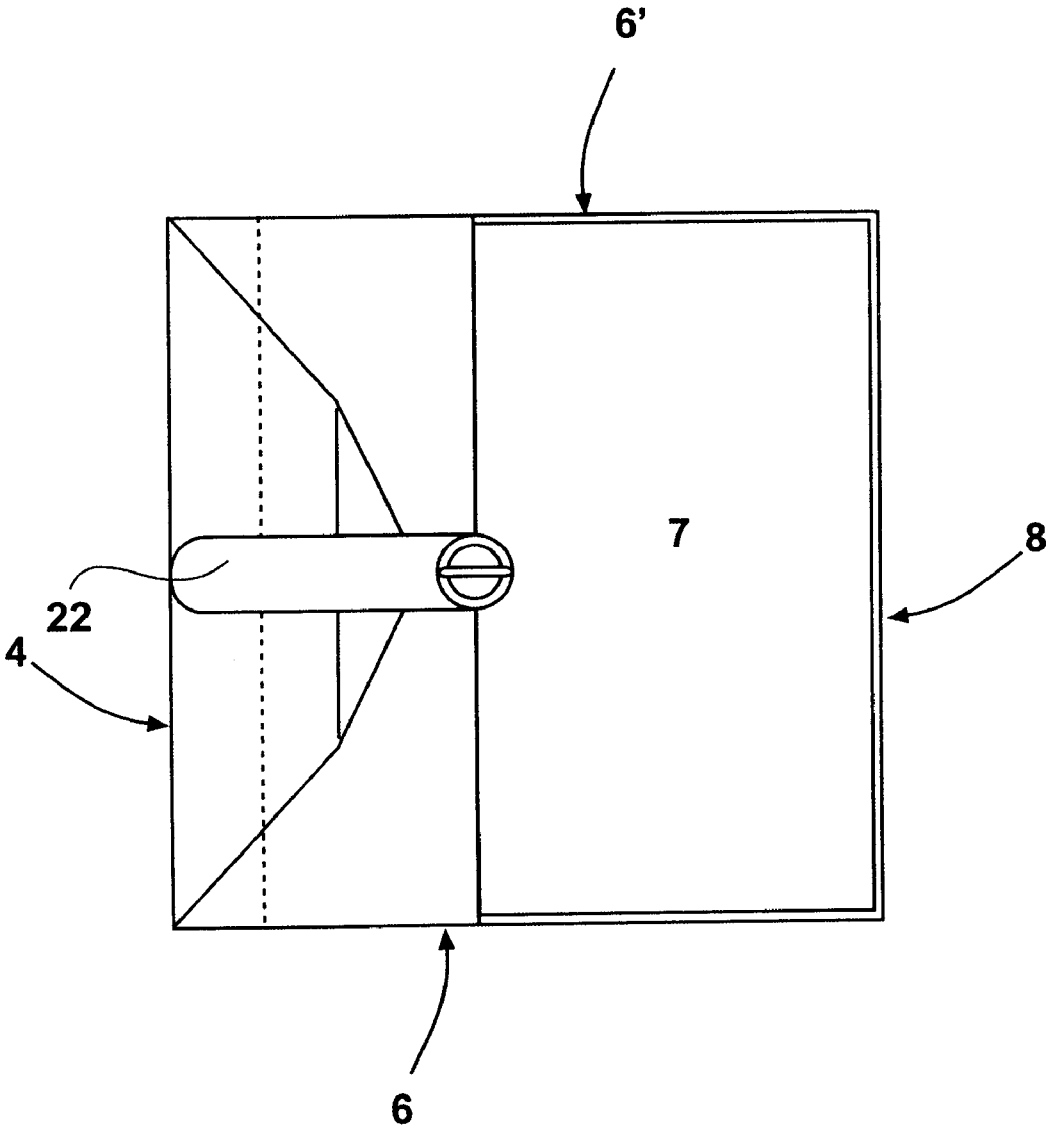
FIG. 5 is a top view of the FIG. 1 embodiment.
Figure 6:
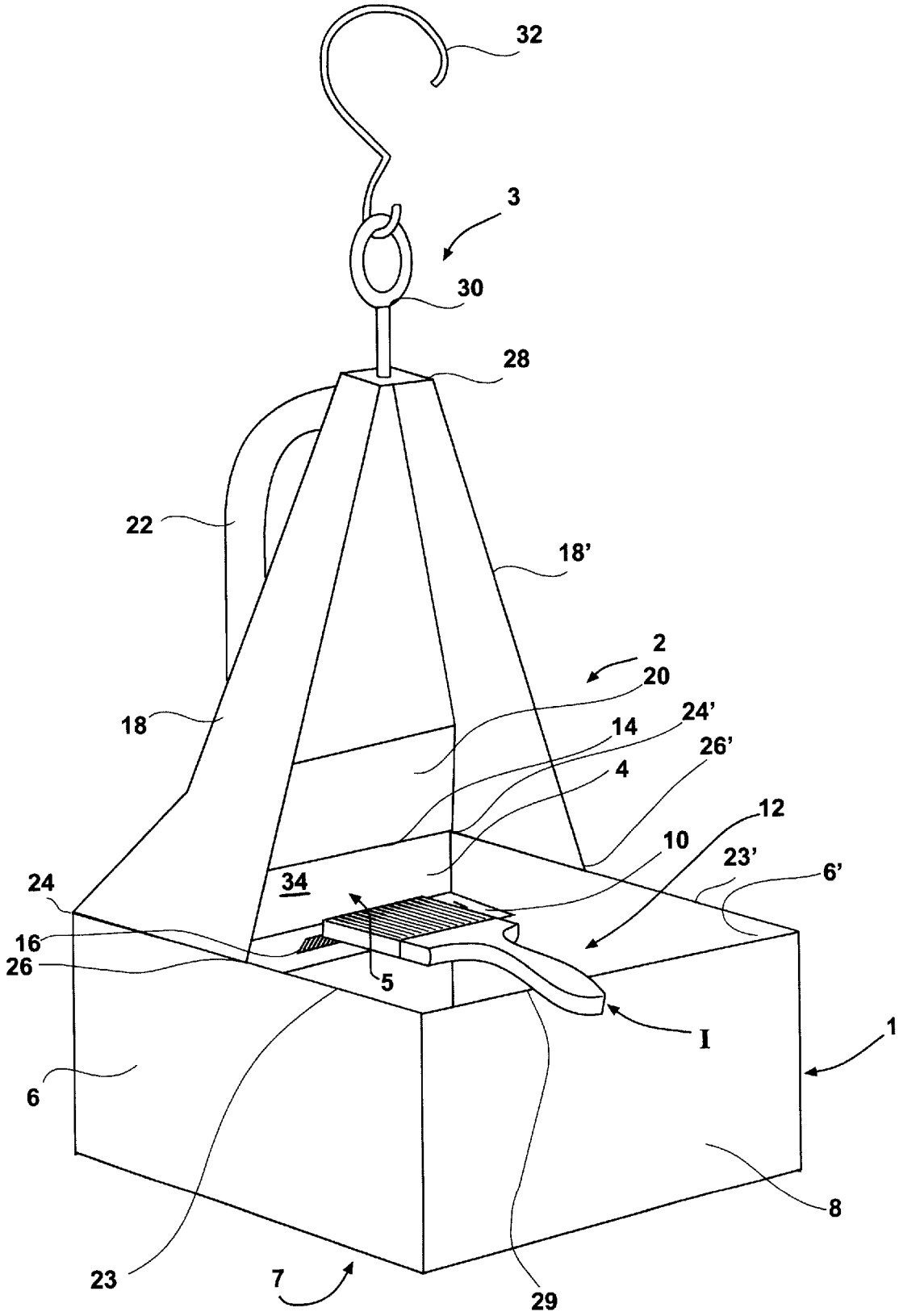
FIG. 6 is a perspective view of the holder embodiment of FIG. 1 shown with a painting instrument resting on the holder.

Referring to FIGS. 1–6 there is shown one, but not the only, embodiment of the preferred embodiment of the invention. The HANDY PAINT HOLDER DEVICE comprises lower section (1), mid section (2) and upper section (3).

Lower portion (1) includes a rectangular base plate (7) with primary wall (4), secondary walls (6, 6') and tertiary wall (8). A generally horizontal elongated ledge (10) rests within positively defined space (12) created by attachment of the base plate with all walls.

The elongated ledge abuts primary wall approximately ½–3 inches below said wall's upper edge limit (14) in retention area (5). Its dimensions are approximately 1–6 inches wide and 4–14 inches long (from 50–100% of the primary side wall's internal length). Elongated ledge may have perforations, a screen or similar porous openings (16) for excess paint removal or drainage.

Mid section (2) includes structural supports (18, 18'), splash guard (20) and handle (22).

Structural supports attach along the upper limit (23, 23') of each secondary wall from comer (24, 24') adjacent to primary wall to medial location (26, 26'), and convergingly extend upwardly until both meet at plateau region (28). Upper edge limit (29) of tertiary wall (8) acts as a straight edge and resting point. Splash guard (20).longitudinally affixes to primary wall's upper edge limit (14), laterally connects with structural supports (18, 18') and extends upwards along the structural supports enough to protect the user from accidental spillage.

Handle (22) doubly attaches at a mid-sectional location of primary wall (4) or guard (12) and at plateau region (28). Alternatively, handle could attach solely at plateau region (28). In either case, the handle is ergonomically formed to address a palm's natural hand curvature and generally exists below the plateau region and above primary wall (4). Preferably, the handle curves outward between the primary wall attachment and the plateau region attachment.

Upper section (3) may include a swivelling ring (30) and/or detachable hook (32) or a clamp (not shown). Swivelling ring (30) would attach at plateau region (28) and provide means to attach detachable hook (32) or an alternative support device such as a clamp.

The HANDY PAINT HOLDER DEVICE may be constructed of metal, non-metal or composite material. Composite material insulative properties are preferred to avoid any possible electrocution risks. Actual production may utilize stamping, forging, welding or injection molding.

Of particular note, the wall having the elongated ledge protrusion will be at least as wide as the width of the application instrument. The top of the tertiary wall also acts as a straight edge for excess media removal from the application instrument.

The user pours paint, varnish, lacquer or other liquid media into the positively defined space of the lower portion. This location provides a low center of gravity for enhanced user agility when at great heights.

An application instrument (I) with said media is laid unattached upon the elongated ledge with the handle resting atop the upper edge (29) of the tertiary wall. The ledge (10) and edge (29) are preferably in parallel planes, with the plane of the ledge slightly below the plane of the edge and the ledge spaced from the edge preferably at opposite sides of the DEVICE. This way, the application instrument (I) rests generally horizontally on the ledge and edge, but, most preferably, at a slight angle relative to horizontal. Preferably, the wet portion of the application instrument (I) rests in the corner or retention area (5) created by the ledge top surface and the upper portion of the primary wall (34), so that the wet portion remains lodged in the retention area during normal movement of the device. The slight angle helps prevent the instrument (I) from sliding off of the DEVICE or into the liquid below the ledge and edge. This placement leaves the instrument (I) in a generally horizontal position but secure position, for example, whereupon the user may climb a ladder with the aid of at least one hand. "Generally horizontal," therefore, includes positions in which the instrument (I) is slanted downward slightly from the handle to the bristles or roller typically at an angle in the range of 3–45 degrees relative to the base of DEVICE, and therefore relative to the base of the DEVICE. More preferably, the angle is in the range of 5–15 degrees relative to horizontal.

At a desired height, the HANDY PAINT HOLDER DEVICE is hung from a projection, such as a ladder rung. The user then dips the application instrument into the liquid, removes excess material using any of the interior surfaces of the device and applies the liquid to a desired surface.

The present invention may appear in alternate embodiments, different than the one described in detail herein. For example: the primary, side and tertiary walls may have different shapes that are bowed or curved for an aesthetically pleasing appearance. In this case, the elongated ledge still exists but, it may have curved lateral edges to accommodate the design change. Still other embodiments may have walls with concave or convex geometries that adapt to the shapes of various application instrument(s) or varied volumetric capacities for the contained media.

Discussion of this invention referenced particular means, materials and embodiments elaborating specific applications of the claimed invention. The invention is not limited to these particulars and applications and applies to all equivalents.

I claim:

1. A painter's liquid container for use with a painter's tool having a handle end and an applicator end, the container comprising:

a lower portion including a rectangular base plate, and a back wall, side walls, and a front wall extending upwardly from said base plate and surrounding and defining an interior space for receiving paint, wherein said front wall has an upper edge and said back wall has an upper edge;

an elongated ledge attached to said back wall below the upper edge of the back wall and extending into the interior space, said elongated ledge having an upper surface for receiving the applicator end of the painting tool that is wet with paint;

a middle portion comprising a plurality of support members upending from the lower portion and having upper ends joining at a support convergence point over said interior space of the lower portion;

a handle for gripping by a user, the handle being attached to said middle portion at said support convergence point and being attached to said back wall.

2. A container as in claim 1, wherein the support members have lower ends connected to the side walls of the lower portion, and the container further comprises a splash guard upwardly extending from the lower portion at or near the upper edge of said back wall, and extending up toward the support convergence point to shield the user from paint splashing out of the interior space.

3. A container as in claim 1, wherein said splash guard extends all the way up to the support convergence point.

4. A painter's liquid container for use with a pointer's tool having a handle end and an applicator end, the container comprising:

a lower portion including a rectangular base plate, and a back wall, side walls, and a front wall extending upwardly from said base plate and surrounding and defining an interior space for receiving paint, wherein said front wall has an upper edge, and said back wall has an upper edge;

an elongated ledge attached to said back wall below the upper edge of the back wall and extending into the interior space, said elongated ledge having an upper surface for receiving the applicator end of the painting tool that is wet with paint;

a middle portion comprising a plurality of support members upending from the lower portion, the support members having lower ends connected to side walls of the lower portion, and having upper ends joining at a support convergence point over said interior space of the lower portion;

a handle for gripping by a user, the handle being attached to said middle portion; and a splash guard upwardly extending from the lower portion at or near the upper edge of said back wall toward the support convergence point to shield [a] the user from paint splashing out of the interior space.

5. A container as in claim 4, wherein said splash guard extends from said upper edge of said back wall to a medial location between said support members.

6. A container as in claim 5, wherein said splash guard extends all the way up to the support convergence point.

7. A container as in claim 4, wherein said handle further attached to said back wall.

8. A container as in claim 4, wherein.said handle further attached to said back wall.

9. A container as in claim 4, wherein said handle attaches to the middle portion at or near the support convergence point and curved downward to connect to said splash guard near the back wall.

10. A combination of a painter's liquid container and a painter's tool having a handle end and an applicator end for being wet with paint, the container comprising:

a lower portion including a rectangular base plate, and a back wall, side walls, and a front wall extending upwardly from said base plate, wherein said base plate, back wall, side walls, and front wall surround and define an interior space for receiving paint, and wherein said front wall has an upper edge and said back wall has an upper edge;

an elongated member attached to said back wall below the upper edge of the back wall and extending into the interior space, said elongated member consisting of a generally horizontal planar ledge receiving the applicator end of the painter's tool;

wherein said upper edge of the front wall receives the handle end of the painter's tool when the applicator end of the tool is placed on said generally horizontal planar ledge, so that the tool lies generally horizontally across the interior space supported by said ledge and said upper edge of the front wall;

wherein said upper edge of the front wall comprises a straight edge portion adapted for removing paint from the applicator end when the painter's tool is lifted up from the ledge and the applicator end is scraped against the straight edge portion.

11. A combination of a painter's liquid container and a painter's tool having a handle end and an applicator end for being wet with paint, the container comprising:

a lower portion including a rectangular base plate, and a back wall, side walls, and a front wall extending upwardly from said base plate, wherein said base plate, back wall, side walls, and front wall surround and define an interior space for receiving paint, and wherein said front wall has an upper edge and said back wall has an upper edge;

an elongated member attached to said back wall below the upper edge of the back wall and extending into the interior space, said elongated member consisting of a generally horizontal planar ledge receiving the applicator end of the painter's tool;

wherein said upper edge of the front wall receives the handle end of the painter's tool when the applicator end of the tool is placed on said generally horizontal planar ledge, so that the tool lies generally horizontally across the interior space supported by said ledge and said upper edge of the front wall;

wherein the container further comprises a middle portion comprising a plurality of support members upending from the lower portion, the support members having lower ends connected to the side walls of the lower portion, and having upper ends joining at a support convergence point over said interior space of the lower portion.

12. A combination as in claim 11, wherein the container further comprises a handle for gripping by a user, the handle being attached to said middle portion at said support convergence point and being attached to said back wall.

13. A combination as in claim 11, further comprising a splash guard upwardly extending from the lower portion at or near the upper edge of said back wall, and extending up toward the support convergence point to shield a user from paint splashing out of the interior space.

* * * * *